US005751121A

United States Patent [19]

Toyama et al.

[11] Patent Number: 5,751,121

[45] Date of Patent: May 12, 1998

[54] HIGH VOLTAGE DISCHARGE BULB CONTROL

[75] Inventors: Koichi Toyama; Noboru Yamamoto, both of Kariya, Japan

[73] Assignee: Denso Corporation, Kariya, Japan

[21] Appl. No.: 756,556

[22] Filed: Nov. 26, 1996

[30] Foreign Application Priority Data

Dec. 27, 1995 [JP] Japan ..... 7-341507

[51] Int. Cl.[6] ..... G05F 1/00

[52] U.S. Cl. ..... 315/307; 315/291; 315/308; 315/DIG. 7

[58] Field of Search ..... 315/291, 307, 315/308, 224, 127, 209 R, 82, DIG. 7

[56] References Cited

U.S. PATENT DOCUMENTS

| | | | |
|---|---|---|---|
| 4,471,268 | 9/1984 | Brown et al. | 315/178 |
| 5,103,143 | 4/1992 | Daub | 315/308 |
| 5,365,152 | 11/1994 | Ozawa et al. | 315/291 |
| 5,485,061 | 1/1996 | Ukita et al. | 315/307 |

FOREIGN PATENT DOCUMENTS 8-162282 6/1996 Japan .

*Primary Examiner*—Robert Pascal
*Assistant Examiner*—Haissa Philogene
*Attorney, Agent, or Firm*—Cushman Darby & Cushman IP Group of Pillsbury Madison & Sutro LLP

[57] ABSTRACT

In a discharge bulb control, a time constant circuit comprised of a capacitor and a resistor is used to determine an electric power to be supplied to a discharge bulb. During a warm-up period of the discharge bulb, the capacitor is charged to produce a voltage which varies, toward a predetermined voltage, with an electric current flowing thereto so that the electric power is increased gradually. After the warm-up control, the time constant for charging the capacitor is reduced to maintain the capacitor voltage at the predetermined voltage. Even with the current leakage occurring in the capacitor after the warm-up control, the electric power is controlled by the predetermined voltage which is not influenced by the current leakage. Thus, the electric power applied to the discharge bulb after the warm-up control can advantageously be maintained at the required level.

8 Claims, 3 Drawing Sheets

VL
Vh
Vℓ

VB1
ΔV
Vcc

Vc

VB2
t0
t1
t2
t3
To
TIME

HIGH VOLTAGE DISCHARGE BULB CONTROL

BACKGROUND OF THE INVENTION

1. Field of the Invention

The present invention relates to a control apparatus and method for a lighting device having a high voltage discharge bulb such as a metal halide bulb used for a vehicle front light.

2. Description of Related Art

A warm-up control for a high voltage discharge bulb is known from JP-A 7-6882, which first applies a larger electric power to a high voltage discharge bulb at the time of quickly turning on the bulb stably than in the period of keeping the normal turned-on condition thereby to raise the temperature of the bulb's electrodes quickly, and then lowers the applied electric power gradually to the power required to maintain the turned-on condition. This warm-up control uses a time constant circuit comprising a capacitor and a resistor and performs the gradual power reduction based on the terminal voltage of the capacitor.

The time constant of the time constant circuit is set to a level corresponding to the heat capacity of the discharge bulb itself. In the case of a discharge bulb which is standardized to 35 W for use in an automotive front light, the time constant is set to about 5 seconds through 10 seconds.

Such capacitors as having several tens of microfarads for the time constant of 5 seconds through 10 seconds have generally an electric current leakage caused by aging or temperature variations. As the current leakage at the time of full-charging of the capacitor increases, the electric power applied during the period of keeping the normal turned-on condition deviates correspondingly from the required power.

SUMMARY OF THE INVENTION

It is therefore an object of the present invention to provide a high voltage discharge bulb control which can maintain an electric power applied to a discharge bulb at a required level irresponsively to the increase in an electric current leakage at the time of full-charging of a capacitor.

According to the present invention, during a warm-up period of a discharge bulb, an electric power supplied to the discharge bulb is controlled based on a voltage which varies, toward a predetermined voltage, with an electric current flowing to a capacitor. After the warm-up control, i.e., during a post-warm-up control period, the electric power is maintained at a level corresponding to the predetermined voltage. Even with the current leakage occurring in the capacitor after the warm-up control, adverse influence of the leakage current is suppressed or the electric power is controlled by the predetermined voltage which is not influenced by the current leakage. Thus, the electric power applied to the discharge bulb after the warm-up control can advantageously be maintained at the required level.

Preferably, after the warm-up control, a voltage dropping element turns on or off to generate the predetermined voltage.

Preferably, the predetermined voltage is provided by reducing a resistance of a charging resistance of a time constant circuit, thereby simplifying a circuit construction for maintaining the required electric power after the warm-up control.

More preferably, the capacitor is connected to a discharging circuit to discharge therethrough gradually by a time constant determined by the discharging circuit. The heat radiation of the discharge bulb after the turning-off can be monitored by way of the terminal voltage of the capacitor. Thus, when the discharge bulb is turned on again, it can be controlled most appropriately to fit to the existing heat radiation condition by starting the electric power supply in accordance with the existing terminal voltage of the capacitor at that time.

BRIEF DESCRIPTION OF THE DRAWINGS

Other objects, features and advantages of the present invention will be made more apparent by the following detailed description with reference to the accompanying drawings, in which.

DETAILED DESCRIPTION OF PRESENTLY PREFERRED EMBODIMENT

Figure 1:
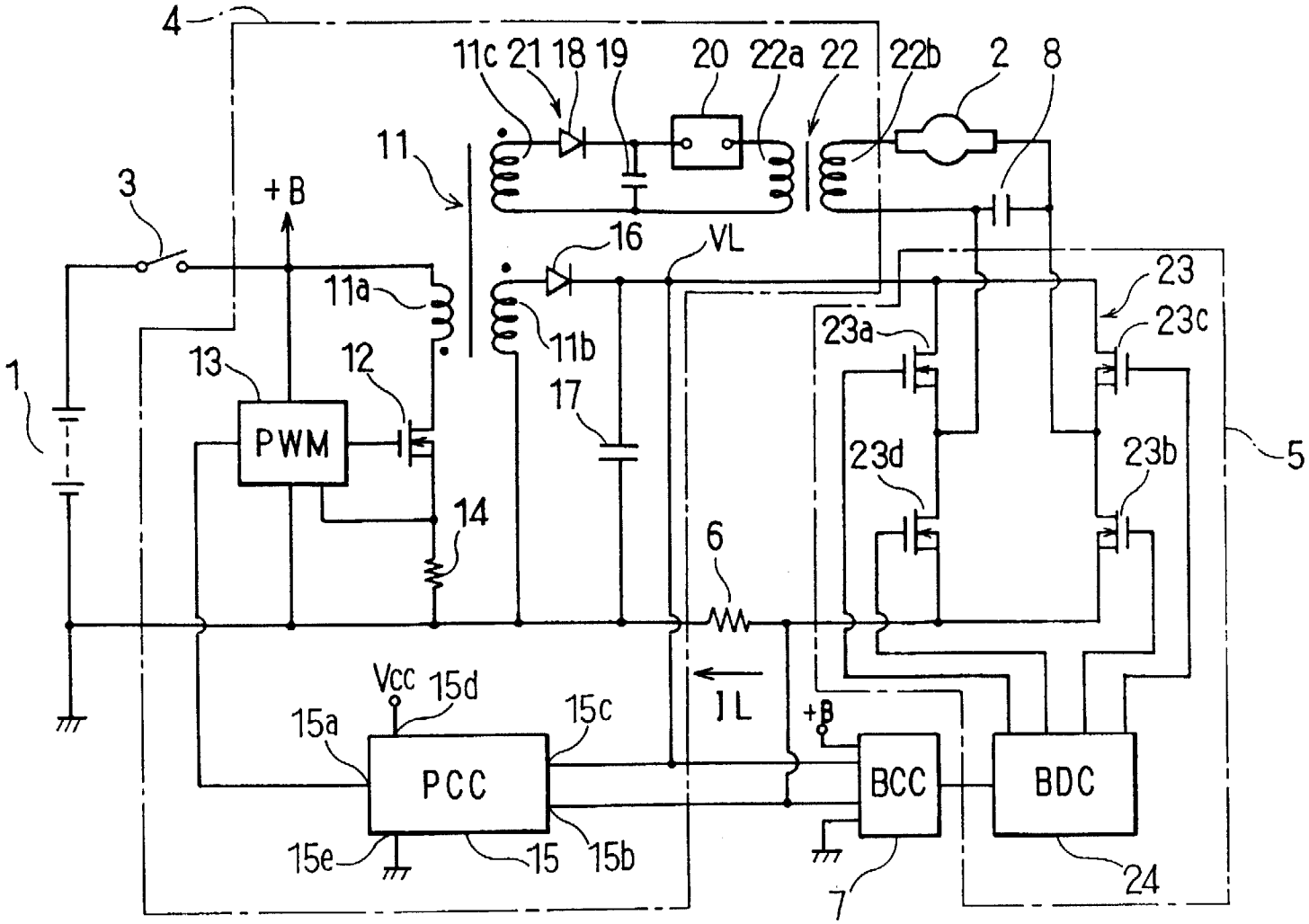
FIG. 1 is an entire electric wiring diagram showing a discharge bulb control according to an embodiment of the present invention.

In a preferred embodiment shown in FIG. 1, numeral 1 denotes an automotive vehicle-mounted storage battery, 2 a high voltage discharge lamp or bulb such as a metal halide bulb used as a vehicle front light, 3 a light switch, 4 a direct current power circuit, 5 an inverter circuit, 6 a current detecting resistor, 7 a bridge control circuit (BCC), and 8 a capacitor for protecting an H-bridge circuit 23 of the inverter circuit 5 from high voltage pulses.

The power circuit 4 includes a fly-back transformer 11 which has a primary winding 11*a* provided at the side of the storage battery 1 and a pair of secondary windings 11*b* and 11*c* provided at the side of the discharge bulb 2. A power MOS transistor 12 is connected to a PWM (pulse width modulation) circuit 13 and the transformer 11 to regulate the primary current flowing through the winding 11*a* by its turning on and off in response to a pulse width-modulated signal from the PWM circuit 13. The PWM circuit 13 is connected to a resistor 14, which detects the primary current, and to a power calculation circuit (PCC) 15 thereby to control a gate voltage of the transistor 12 so that the detected primary current coincides with a command value from the power calculation circuit 15. The power calculation circuit 15 calculates an electric power supplied to the discharge bulb 2 from the terminal voltage of a smoothing capacitor 17, i.e., bulb voltage VL of the discharge bulb 2, the bulb current IL detected by the current detecting resistor 6 and the terminal voltage Vc of a capacitor 111 (FIG. 2), and determines the command value to the PWM circuit 13 based on the calculated electric power of the discharge bulb 2. The power calculation circuit 15 is constructed to command a comparatively large electric power to the discharge bulb 2 at the time immediately after turning-on of the switch 3 and thereafter a varying electric power during a warm-up period of the discharge bulb 2 so that the electric power to the discharge bulb 2 gradually decreases to the power required to maintain the normal or stable lighting operation after the warm-up period.

The power circuit 4 further includes a rectifying diode 16 and smoothing capacitor 17, which are connected to the secondary winding 11*b* to rectify and smooth alternating current voltages generated by the secondary winding 11*b* so that the rectified-and-smoothed voltage is applied to an H-bridge circuit 23 of the inverter circuit 5. The power circuit 4 also includes a starting circuit 21 connected to the secondary winding 11*c*. The starting circuit 21 has, as well as a rectifying diode 18 and a smoothing capacitor 19 for rectifying and smoothing alternating current voltages generated by the secondary winding 11*c*, a discharge gap 20 which causes therein an electric discharge when the terminal voltage of the capacitor 19 rises above a predetermined voltage. The discharge gap 20 connects to a high voltage coil 22 having a primary winding 22*a* and a secondary winding 22*b* so that, when the discharge current of the discharge gap 20 flows through the primary winding 22*a*, the secondary winding 22*b* generates the high voltage pulse thereby to excite the discharge bulb 2.

The inverter circuit 5 includes H-bridge circuit 23, which comprises four power MOS transistors 23*a* through 23*d*, and a bridge drive circuit 24. The bridge drive circuit 24 is constructed to receive control signals from the bridge control circuit 7 and responsively turn on and off one pair of the transistors 23*a*, 23*b* and the other pair of the transistors 23*c*, 23*d* alternately.

Figure 2:
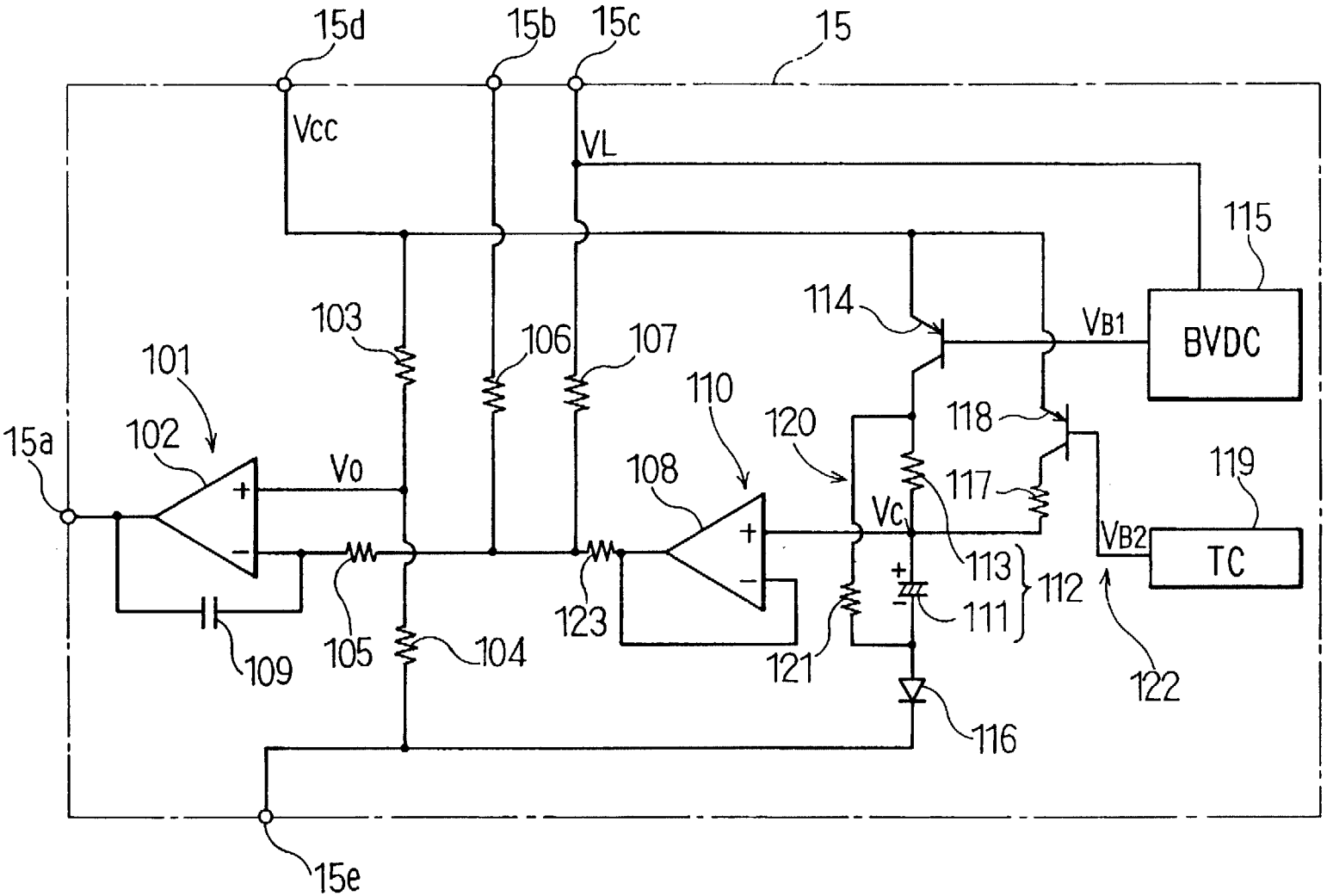
FIG. 2 is an electric wiring diagram showing a power calculation circuit used in the embodiment of FIG. 1.

The power calculation circuit (PCC) 15 is constructed as shown in FIG. 2. In this circuit 15, an operational amplifier 102, which operates an error amplifier circuit 101, has an output terminal 15*a*, a non-inverting input terminal and an inverting input terminal. The output terminal 15*a* is connected to the PWM circuit 13. The non-inverting terminal is connected to the junction between resistors 103 and 104 which produces a reference voltage Vo by dividing a constant voltage Vcc applied between terminals 15*d* and 15*e*. The inverting terminal is connected to a bulb current detecting terminal 15*b* through resistors 105 and 106, to a bulb voltage detecting terminal 15*c* through resistors 105 and 107, and to the output terminal of another operational amplifier 108 through resistors 105 and 123. A capacitor 109 is connected to the amplifier 102 to suppress its oscillation. Thus, the error amplifier circuit 101 subtracts from the reference voltage Vo the sum of voltages, i.e., sum of a voltage proportional to the bulb voltage VL, a voltage proportional to the bulb current IL and the output voltage of the amplifier 108, and amplifies the resulting voltage to be applied to the PWM circuit 13.

The operational amplifier 108 is constructed as a voltage follower circuit 110 by feedbacking the output voltage to the inverting input terminal. The non-inverting input terminal of the amplifier 108 is connected to a positive terminal of a capacitor 111, which forms together with a resistor (voltage dropping resistor) 113 the time constant circuit 112 for setting the warm-up electric power. A semiconductor switching transistor 114 is connected between the constant voltage (Vcc) terminal 15*d* and the resistor 113. The transistor 114 is connected at its base to a bulb voltage detecting circuit (BVDC) 115, which is constructed to turn on the transistor 114 by maintaining the base voltage VB1 at the low voltage level only when the bulb voltage VL is between the predetermined low voltage V1 and the predetermined high voltage Vh. A diode 116 is connected between the negative terminal of the capacitor 111 and the ground terminal 15*e* to prevent reverse flow of the discharging current at the time of discharging of the capacitor 111.

In parallel to the time constant circuit 112, a discharging circuit 120 comprising a resistor 121 is connected. Further, in parallel to the series circuit of resistor 113 and transistor 114 of the time constant circuit 112, another series circuit of a semiconductor switching transistor 118 and a resistor 117 having a lower resistance than the resistor 113 is connected for voltage dropping operation. The transistor 118 is connected at its base to a timer circuit (TC) 119, which forms together with the resistor 117 and the transistor 118*a* a charging resistance reduction circuit 122 for setting the electric power after the warm-up operation. Thus, the charging resistance reduction circuit 122 is provided separately from the time constant circuit 112 to produce a predetermined voltage as a reference for controlling the electric power to the discharge bulb 2 after the initial turning-on of the bulb 2, i.e., during normal or stable lighting period. The timer circuit 119 is so constructed as to maintain the base voltage VB2 of the transistor 118 at the high level to turn off the transistor 118 from the turning-on of the light switch 3 to the normal lighting, and to maintain the base voltage VB2 at the low level to turn on the transistor 118 after the warm-up control.

The embodiment operates generally as described in U.S. patent application Ser. No. 08/670,123, filed on Jun. 25, 1996 based on Japanese patent application Nos. 7-319157 and 7-164063, which is incorporated herein by reference. The power calculation circuit (PCC) 115, operates as shown in FIGS. 3A through 3D.

Figures 3A, 3B, 3C, 3D:
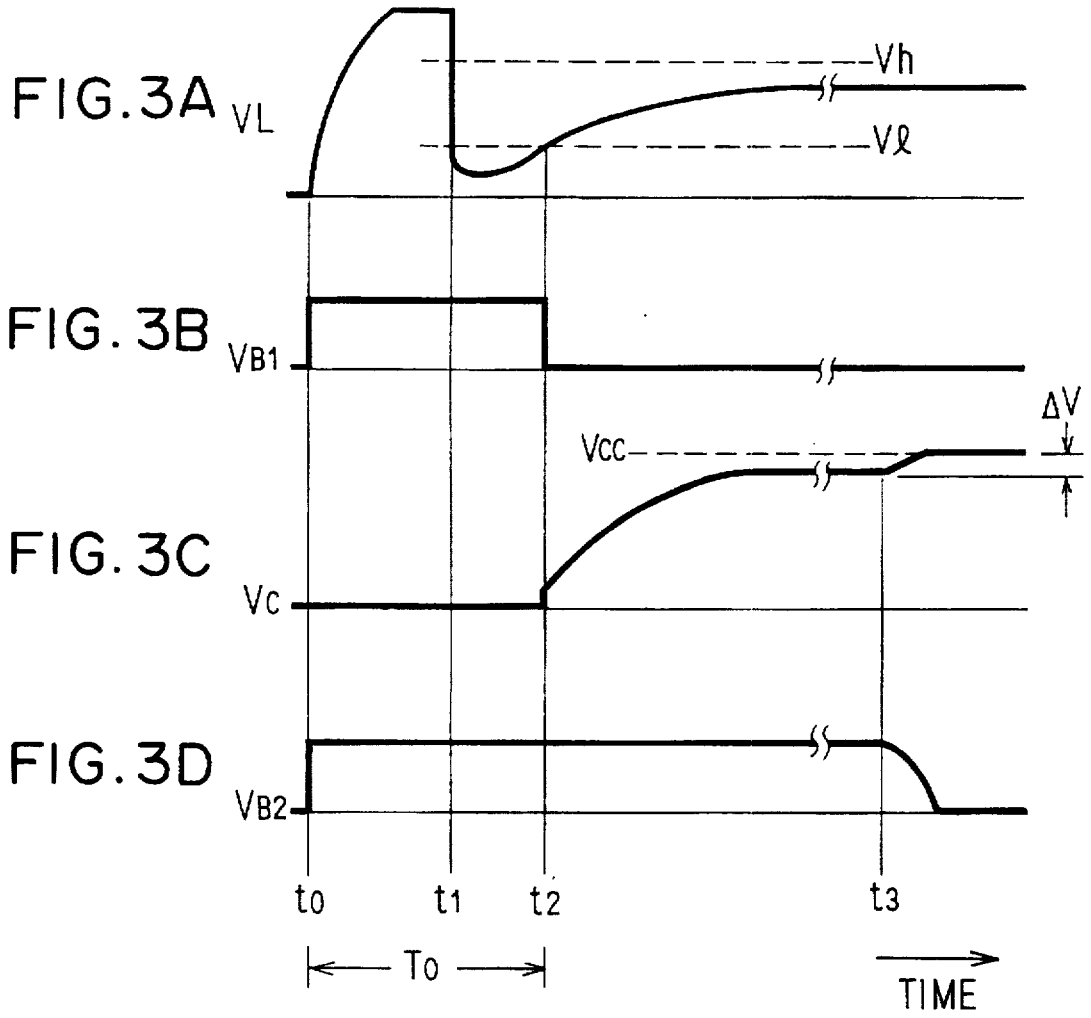
FIGS. 3A through 3D are timing charts showing signal waveforms developed in the power calculation circuit.

When the light switch 3 is turned on at a time t0 under the condition that the capacitor 111 has no electric charge, as shown in FIG. 3A, the bulb voltage VL first increases, then instantly drops at a time t1 at which the discharge bulb 2 starts discharging, and gradually increases after the lighting of the discharge bulb 2 so that the discharge bulb 2 performs the normal lighting operation.

During a period T0 from the time t0 (turning--on of the light switch 3) to a time t2 at which the bulb voltage VL rises again to the predetermined low voltage V1 after the instantaneous voltage drop at the time t1, the bulb voltage detecting circuit 115 maintains the base voltage VB1 of the transistor 114 at the high level as shown in FIG. 3B thereby to turn off the transistor 114. During this period, the timer circuit 119 maintains the base voltage VB2 of the transistor 118 at the high level as shown in FIG. 3D to turn off the transistor 118. As a result, no electric charging current flows to the capacitor 111, and hence the terminal voltage Vc and the output voltage of the amplifier 108 are maintained at 0 volt as shown in FIG. 3C. For this reason, the output voltage of the amplifier 102 developed during the period T0 becomes large in comparison with that developed during the normal stable lighting operation, so that a comparatively large electric power is supplied to the discharge bulb 2 thereby to raise the temperature of electrodes of the discharge bulb 2 quickly.

Because the bulb voltage VL rises above the predetermined low voltage V1 after the time t2, the bulb voltage detecting circuit 115 reverses the base voltage VB1 of the transistor 114 to the low level to turn on the transistor 114. As a result, an electric charging current flows to the capacitor 111 so that, as shown in FIG. 3C, the terminal voltage Vc and the output voltage of the amplifier 108 increases toward the constant voltage Vcc (specifically, a voltage corresponding to the voltage Vcc minus the voltage drop by the transistor 114) at the time constant determined by the capacitance of capacitor 111 and the resistance of resistor 113. The output voltage of the amplifier 102 responsively decreases so that the electric power to the discharge bulb 2 decreases gradually toward the power level required to maintain stably the normal lighting operation of the discharge bulb 2. In the event that the capacitor has electric current leakage, the terminal voltage Vc of the capacitor 111 does not rise closely enough to the constant voltage Vcc even if it is in a fully charged condition. That is, the terminal voltage Vc rises only to a voltage level which is lower than the constant voltage Vcc by the sum of a voltage drop ΔV corresponding to the leakage current and the voltage drop of the transistor 114. Without no compensation for the voltage drop ΔV, the electric power actually supplied to the discharge bulb 2 during the normal lighting operation deviates from the power level required for the normal lighting operation.

At a time t3 which corresponds to a termination point of the warm-up control, the timer circuit 119 reverses the base voltage VB2 of the transistor 118 to the low level to turn on the transistor 118. With the turning-on of the transistor 118, another charging current to the capacitor 111 flows through the resistor 117. As the resistance of resistor 117 is sufficiently smaller than that of the resistor 113, the composite resistance of the two resistors 113 and 117 becomes sufficiently smaller than that of the resistor 117. As a result, a total resistance to charging the capacitor 111 greatly reduces, that is, the voltage drop at the parallelly-connected resistors 113 and 117 resulting from the leakage current of the capacitor 111 greatly reduces. Therefore, the terminal voltage Vc of the capacitor 111 rises by about the voltage drop ΔV and reaches the level approximately equal to the constant voltage Vcc as shown in FIG. 3C. With this rise of terminal voltage Vc sufficiently closely to the constant voltage Vcc, the electric power actually supplied to the discharge bulb 2 approximately equals the power level required for maintaining the normal lighting operation stably so that the discharge bulb 2 may provide the desired light output.

As shown in FIG. 3D, the base voltage VB2 of the transistor 118 is not changed instantaneously from the high level to the low level but changed gradually or smoothed. This gradual change in the base voltage Vb2 will prevent an instantaneous change in the light output of the discharge bulb 2. It is to be noted however that the gradual change or smoothing need not be necessarily provided, because the voltage drop ΔV is generally small and will result in comparatively a small change in the light output.

When the light switch 3 is turned off, the discharge bulb 2 turns off and the capacitor 111 starts to discharge through the resistors 113 and 121. The terminal voltage Vc of the capacitor 111 decreases gradually toward 0 volt at a time constant determined by the capacitance of capacitor 111 and the composite resistance of serially-connected resistors 113 and 121. By appropriately setting the discharging time constant, the terminal voltage Vc of the capacitor 111 can be regulated to be in accord with the heat radiation characteristics of the discharge bulb 2. In this case, when the light switch 3 is turned on again to excite the discharge bulb 2, the electric power to the discharge bulb 2 starts from the power level corresponding to the existing terminal voltage Vc of the capacitor 111. Therefore, the discharge bulb 2 can be turned on by an electric power best fit to the existing heat radiation condition, i.e., existing temperature of the electrodes of discharge bulb 2.

During discharging of the capacitor 111, the diode 116 stops reverse flow of the discharging current to a power circuit and assures that the changing characteristics of the terminal voltage Vc follows the heat radiation characteristics of the discharge bulb. It is of course possible to stop the reverse flow of the capacitor discharging current by connecting the diode 116 to the positive side of the capacitor 111 instead of connecting to the negative side of the capacitor 111.

According to the embodiment described above, the electric power to be supplied to the discharge bulb 2 after the warm-up control is controlled by the voltage of the predetermined level (approximately equal to the constant voltage Vcc) produced by the charging resistance reduction circuit 122 provided separately from or additionally to the time constant circuit 112. Therefore, the electric power to the discharge bulb 2 can be maintained at the required power level even when the electric charge of the capacitor 111 leaks in the fully-charged condition of the capacitor 111. Further, the charging resistance reduction circuit 122 is constructed by the resistor 117, which is provided between the capacitor 111 and the constant voltage supply terminal **15*d* and has a resistance smaller than that of the resistor 113 of the time constant circuit 112. Therefore, the voltage of the predetermined level can be set to be approximately equal to the constant voltage Vcc by a simple circuit configuration and-no substantial changes in the predetermined level voltage will be caused by variations in characteristics of circuit elements. Still further, after the turning-off of the discharge bulb 2, the heat radiation condition of the discharge bulb 2 is monitored by the terminal voltage Vc of the capacitor 111 which discharges gradually at the time constant determined by the discharging circuit 120. Therefore, the electric power control for re-exciting the discharge bulb 2 can start based on the existing capacitor terminal voltage Vc and the re-exciting the discharge bulb 2 can be made to fit to the existing heat radiation condition of the discharge bulb 2**.

The above-described embodiment may be modified in that, while using the capacitor terminal voltage Vc for controlling the electric power to the discharge bulb during the warm-up period, the predetermined level voltage may be produced not by the time constant circuit 112 having the capacitor 111 but by a voltage dividing circuit having fixed resistors for use in the electric power control after the warm-up control. For instance, a series circuit of a semiconductor transistor and a resistor having a large resistance may be connected in parallel with the capacitor 111 and this transistor may be controlled in the same manner as the transistor 118 is controlled in the embodiment.

Other modifications and alterations of the embodiment will be made without departing from the spirit and the scope of the invention.

What is claimed is:

1. A discharge bulb control apparatus comprising:

a discharge bulb;

warm-up power setting means including a time constant circuit which has a capacitor and producing a voltage which determines an electric power to be supplied to the discharge bulb and changes toward a first predetermined level in response to a capacitor current flowing to the capacitor during a warm-up period of the discharge bulb; and post-warm-up power setting means for causing the capacitor in the time constant circuit to be at a voltage of a second predetermined level different from the first predetermined level after the warm-up period.

2. A discharge bulb control apparatus comprising:

a discharge bulb;

warm-up power setting means including a time constant circuit which has a capacitor and producing a voltage which determines an electric power to be supplied to the discharge bulb and chances toward a predetermined level in response to a capacitor current flowing to the capacitor during a warm-up period of the discharge bulb, said warm-up power setting means including a first voltage dropping element in the time constant circuit; and post-warm-up power setting means for producing a voltage of the predetermined level after the warm-up period, said post-warm-up power setting means including a voltage dropping circuit which has a semiconductor switching element and a second voltage dropping element provided separately from the first voltage dropping element.

3. A discharge bulb control apparatus comprising:

a discharge bulb;

warm-up power setting means including a time constant circuit which has a capacitor and producing a voltage which determines an electric power to be supplied to the discharge bulb and chances toward a predetermined level in response to a capacitor current flowing to the capacitor during a warm-up period of the discharge bulb; and post-warm-up power setting means for producing a voltage of the predetermined level after the warm-up period, wherein the post-warm-up power setting means reduces a charging resistance of the time constant circuit thereby to cause the warm-up power setting means to produce the voltage of the predetermined level.

4. A discharge bulb control apparatus according to claim 3, further comprising:

a discharging circuit connected in parallel with the capacitor.

5. A discharge bulb control method comprising the steps of:

starting to drive a discharge bulb by a starting circuit immediately after a turning-on of a light switch;

charging a capacitor of a time constant circuit after a completion of the starting step thereby to produce a charge voltage varying at a time constant determined by the time constant circuit;

varying, for warming up the discharge bulb, an electric power supplied to the discharge bulb in correspondence with the charge voltage produced by the capacitor charging step;

providing a predetermined level voltage after the capacitor is charged fully, the predetermined voltage being higher than the charge voltage and compensating for a voltage drop of the charge voltage caused by a current leakage of the capacitor; and maintaining, after the warming-up of the discharge bulb, the electric power to the discharge bulb in correspondence with the predetermined level voltage.

6. A discharge bulb control method comprising the steps of:

starting to drive a discharge bulb by a starting circuit immediately after a turning-on of a light switch;

charging a capacitor of a time constant circuit after a completion of the starting step thereby to produce a charge voltage varying at a time constant determined by the time constant circuit;

varying, for warming up the discharge bulb, an electric power supplied to the discharge bulb in correspondence with the charge voltage produced by the capacitor charging step;

providing a predetermined level voltage after the capacitor is charged fully, the predetermined voltage compensating for a voltage drop of the charge voltage caused by a current leakage of the capacitor; and maintaining, after the warming-up of the discharge bulb, the electric power to the discharge bulb in correspondence with the predetermined level voltage, wherein the predetermined level voltage providing step varies the time constant of the time constant circuit by connecting to the time constant circuit a resistor externally so that a charging resistance to the capacitor is reduced.

7. A discharge bulb control method comprising the steps of:

starting to drive a discharge bulb by a starting circuit immediately after a turning-on of a light switch;

charging a capacitor of a time constant circuit after a completion of the starting step thereby to produce a charge voltage varying at a time constant determined by the time constant circuit;

varying, for warming up the discharge bulb, an electric power supplied to the discharge bulb in correspondence with the charge voltage produced by the capacitor charging step;

providing a predetermined level voltage after the capacitor is charged fully, the predetermined voltage compensating for a voltage drop of the charge voltage caused by a current leakage of the capacitor;

maintaining, after the warming-up of the discharge bulb, the electric power to the discharge bulb in correspondence with the predetermined level voltage; and discharging the capacitor when the light switch is turned off to turn off the discharge bulb; and re-supplying, when the light switch is turned on again, the electric power to the discharge bulb from a value corresponding to the capacitor voltage existing at that time.

8. A discharge bulb control apparatus comprising:

a discharge bulb;

a voltage detection circuit for detecting a voltage applied to the discharge bulb;

a current detection circuit for detecting a current flowing to the discharge bulb;

warm-up power setting means including a time constant circuit which has a capacitor for producing a voltage changing toward a predetermined level in dependence on a capacitor current flowing to the capacitor;

post-warm-up power setting means for changing the voltage produced from the warm-up power setting means to the predetermined voltage irrespectively of deterioration of the capacitor; and power control means for controlling an electric power supplied to the discharge bulb based on outputs of the voltage detection circuit, the current detection circuit and the warm-up power setting means during a warm-up period of the discharge bulb, and controlling the electric power supplied to the discharge bulb based on outputs of the voltage detection circuit, the current detection circuit and the post-warm-up power setting means after the warm-up period of the discharge bulb.

* * * * *